United States Patent [19]

Maurer

[11] Patent Number: 4,732,349

[45] Date of Patent: Mar. 22, 1988

[54] BEAMRIDER GUIDANCE SYSTEM

[75] Inventor: Hans A. Maurer, Tarzana, Calif.

[73] Assignee: Hughes Aircraft Company, Los Angeles, Calif.

[21] Appl. No.: 916,595

[22] Filed: Oct. 8, 1986

[51] Int. Cl.[4] ..... F41G 7/24

[52] U.S. Cl. ..... 244/3.13

[58] Field of Search ..... 244/3.13

[56] References Cited

U.S. PATENT DOCUMENTS

| | | | |
|---|---|---|---|
| 3,761,180 | 9/1973 | Maxwell, Jr. et al. | 244/3.13 |
| 3,796,396 | 3/1974 | Crovella | 244/3.13 |
| 4,433,818 | 2/1984 | Coffel | 244/3.13 |

*Primary Examiner*—Charles T. Jordan

[57] ABSTRACT

A guidance apparatus (10) for guiding a missile (18) to a target (20) by a beam (16) is disclosed. The apparatus (10) includes a device (12) for projecting the beam (16), the orientation of which controls the flight path of the missile (18). The missile (18) includes a circuit for generating a signal when the missile (18) is in a predetermined spatial relationship (e.g., the center coded portion) with respect to said beam (16). When such signal is generated, the angular position of the missile with respect to the target is determined. This positioned relationship is then provided to ground based circuitry (56, 58 and 60) which forms a part of apparatus (10) and which adjusts the orientation of the beam (16) to reduce the angular separation of missile and target.

17 Claims, 2 Drawing Figures

BEAMRIDER GUIDANCE SYSTEM

BACKGROUND OF THE INVENTION

1. Field of the Invention

This invention relates to the field of guidance systems, and more particularly concerns a beamrider guidance system with feedback.

2. Description of Related Art

Beamrider guidance systems are often used in missile systems to guide a missile to a target. Such systems often use a beam which is projected onto the target by a projector or in a lead angle direction with respect to the target. The beam is initially referenced to the target by the operator which views the target through a boresight. Because the boresight is often mechanically or electrically linked to the projector, movement of the boresight causes a similar movement in the projector and therefore the beam. Once the target is located through the boresight, the missile is launched and follows the beam to the target.

During flight, the beam is received by a detector on the missile and is used by the missile electronics to determine whether the flight path of the missile should be corrected. Such a determination is possible since the beam is generally spatially encoded. If the missile strays outside the center of the beam, the detector senses the signal encoded in the beam which indicates the missile's relative position with respect to the center of the beam. The detector then delivers an appropriate signal to the autopilot of the missile to cause the autopilot to adjust the flight path of the missile. In this manner, the missile is able to correct for variations in its flight path while following the beam to the target.

To ensure that the beam is focused with respect to the target when the target was sighted through the boresight, the geometric relationship between the boresight and the projector optical axis, in particular the center of the coded beam cross-section, had to be accurately calibrated. If the position of the boresight with respect to the projector reference coordinate system was not so calibrated, sighting the target through the boresight would not always cause the beam to be directed on or referenced to the target. Further, once the boresight was calibrated with the projector optical axis and the center of the coded field during assembly, the calibration could not easily be maintained as the launcher containing the boresight and the projector was often jarred during use. In addition, the detector on the missile which received the beam often had errors caused by biases and offset unbalances which degraded overall guidance performance. Finally, the initial calibration was often difficult to achieve as the boresight, the projector optical axis and the far field coding center often do not lend themselves to production oriented, repeatable tests and calibration procedures. In addition, and the projector often did not have the same optical center as the boresight.

SUMMARY OF THE INVENTION

According to the preferred embodiment of the present invention, a guided missile apparatus for guiding a missile to a target by a beam is disclosed. The apparatus includes a device for projecting the beam, the orientation of which controls the flight path of the missile. The apparatus also includes a circuit for generating a signal when the missile is in a predetermined spatial relationship with respect to said beam. In addition, the apparatus further includes a device for adjusting the orientation of the beam in response to the signal generated when the missile is in the predetermined spatial relationship with respect to the beam.

BRIEF DESCRIPTION OF THE DRAWINGS

Various advantages of the present invention will become apparent to one skilled in the art upon reading the following specification and by reference to the following drawings in which.

DESCRIPTION OF THE PREFERRED EMBODIMENT

Figure 1:
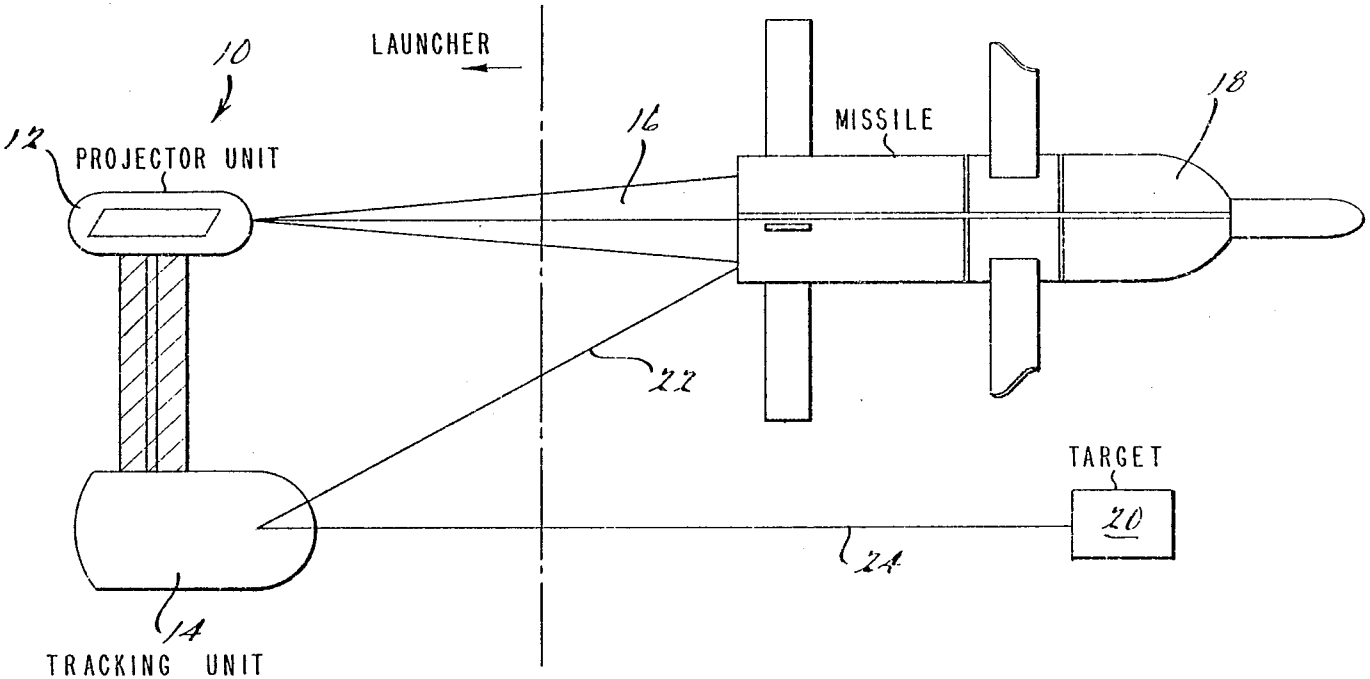
FIG. 1 illustrates the operation of the beamrider guidance system according to the present invention.

Referring to FIG. 1, a launcher 10 is provided which includes a projector unit 12 and a tracking unit 14 having a boresight. The projector unit 12 is used to produce a coded beam 16 of radiation which may be used to control the position of a missile 18 as discussed below. While the projector unit 12 may be used to generate the beam 16 by using a laser, it is to be understood that other infrared or millimeter wave source and other forms of radiation may be used. The tracking unit 14 is used to determine the relative position of the missile 18 to the target 20. The actual instantaneous location of the missile 18 with respect to the center of the coded beam is determined by sensing a beacon signal generated by a beacon and shutter arrangement discussed subsequently when the missile is in the null or center of the code field of the beam 16. The position of the target 20 is either determined by the operator of the unit 14 who views the target 20 through the boresight of the tracking unit 14 or by an automatic target tracker. The tracking unit 14 is thereby able to compare the two dimensional angles between the beacon track line 22 (i.e., the line from the beacon to the beacon gate described below) to the target track line 24 (i.e., the line from the target 20 to the target gate described below). By calculating the angles between the beacon track line 22 and the target track line 24 defined by the center of the target gate described below, the direction of the center of the beam 16 can be adjusted to correct for any boresighting errors and permit the beam 16 to accurately guide the missile 18 to the target 20.

Figure 2:
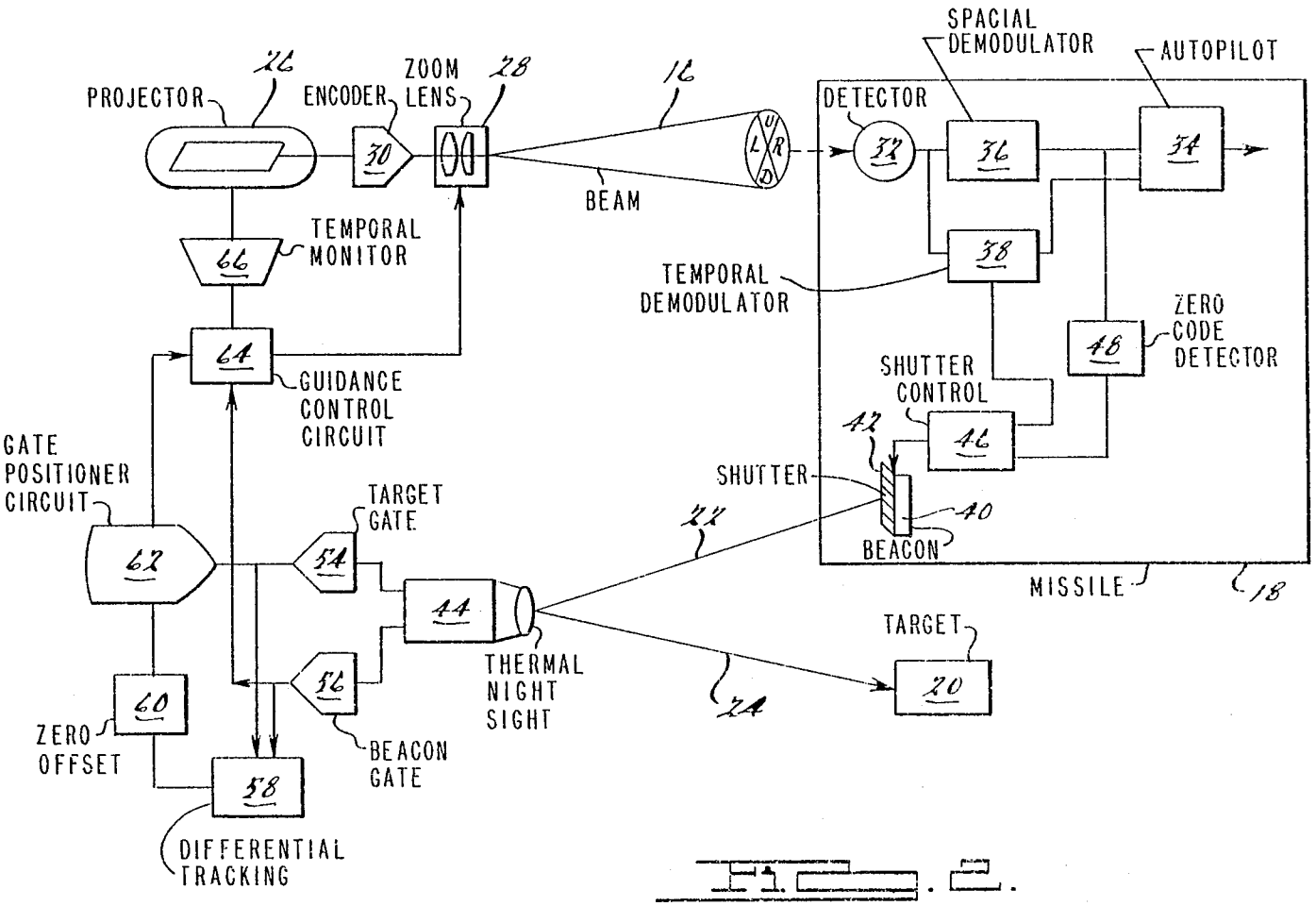
FIG. 2 is a block diagram of the components used in the beamrider guidance system shown in FIG. 1.

The projector unit 12 comprises a projector 26 which is operated to generate a laser beam. The output from the projector 26 is delivered to a zoom lens 28 through a spatial encoder device 30 such as a reticle, polarization cell, or a raster scanner. The spatial encoder device 30 permits the beam to be encoded in such a manner as to allow the missile 18 to determine its relative position with respect to the center or zero code region of the beam 16. As shown in FIG. 2, the missile 18 will receive a "U" signal if it is above the center of the beam 16, while it will receive a "D" signal if it is below the beam 16. Similarly, the missile 18 can determine whether it is left or right of the beam center upon receipt of either a "L" or "R" signal.

To detect the beam 16 from the projector 26, a detector 32 is provided. The detector 32 is optically accessed from the rear of the missile 18 and electrically communicates with the autopilot 34 of the missile 18 through a spatial code demodulator circuit 36 and a temporal demodulator circuit 38. The spatial code demodulator circuit 36 is used to supply the autopilot 34 with the appropriate correction signals to enable the autopilot 34 to adjust the flight path of the missile 18. The temporal demodulator circuit 38 is used to support the system collimation or boresighting function of the beacon 40 by providing a "shutter open" signal when the missile 18 crosses the zero code region.

Beacon 40 is provided at the rear of the missile 18 to optically communicate through a shutter 42 with the beacon gate of a thermal night sight 44 described below. When the shutter 42 is open, infrared radiation emitted by the beacon 40 can be received by the thermal night sight 44. When the shutter 42 is closed, substantially all of the infrared radiation emitted from the beacon 40 is prevented from reaching the thermal night sight 44. To control the activation of the shutter 42, a shutter control circuit 46 is provided. The shutter control circuit 46 electrically communicates with the temporal demodulator circuit 38 and a zero code crossing detector circuit 48. When the missile 18 is outside the center of the beam 16, the temporal demodulator circuit 38 delivers a signal to the shutter control circuit 46 which closes the shutter 42. When the missile is in the center of the beam, the zero code crossing detector circuit 48 delivers a signal to the shutter control circuit 46 which causes the shutter 42 to open.

To identify the position of the missile 18 and the target 20, the tracking unit 14 includes a thermal nightsight 44 which receives the thermal radiation from the target 20 along the target track line 24. When the shutter 42 is open, thermal radiation from the beacon 40 is also received by the thermal nightsight 44 along the beacon track line 22. To distinguish the target 20 from the background radiation, the thermal nightsight 44 entails the use of a target gate 54. The target gate 54 is used to distinguish background radiation from that generated by the target 20. To distinguish the missile 18 and its beacon 40 from the background radiation, the thermal nightsight 44 further communicates with a beacon gate 56. The beacon gate 56 is used to distinguish between the background radiation and that produced by the beacon 40 when the shutter 42 is open.

To determine the angular separation between the target track line 24 and the beacon track line 22, the output of the target gate 54 and the beacon gate 56 are delivered to a differential tracking line circuit 58. The differential tracking line circuit 58 is used to compare the angular difference between the target track line 24 and the beacon track line 22. The output of the differential tracking line circuit 58 is delivered to a zero offset computation circuit 60 which adjusts for the two differential angles which separate the zero code beam center from the boresight. The output from zero offset computation circuit 60 is delivered to a gate positioner circuit 62 which calculates the corrections in the orientation of the center of beam 16 required to precision guide the missile 18 to the target 20. The output from the gate positioner circuit 62 is also delivered to a guidance control circuit 64. The guidance control circuit 64 uses the output of the gate positioner circuit 62 to adjust the focusing of the zoom lens 28 as well as the excitation of the laser 26 through a temporal modulator circuit 66. Accordingly, both the direction of the projector 26 as well as the operation of the zoom lens 28 are responsive to the angular separation between the beacon track line 22 and the target track line 24. For small deviations in boresight in terms of percentage of the field of view, only corrections to the zero code positions are necessary. In the case of large deviations, an optical correction is made with respect to the orientation of the axis of the beam 16.

In practicing the method of the present invention, a non-limiting example will be presented. The projector unit 12 of the launcher generates a spatially encoded beam 16. The detector 32 on the missile 18 receives the encoded beam 16 and generates a signal to the autopilot of the missile 18. If the detector 32 and the decoder 36 determine that the missile 18 is travelling in the zero code region of the beam 16, the zero code crossing detector circuit 48 activates the shutter 42 to permit exposure of the beacon 40. If the missile 18 is not travelling in the zero code region of the beam 16, the temporal demodulator circuit 38 of the missile 18 generates a signal which causes the shutter 42 to remain closed. If the beacon 40 is exposed, the beacon signal is delivered along the beacon track line 22 to the thermal nightsight 44. Also delivered to the thermal nightsight 44 is the target signal which is received along the target track line 24. The differential angles between the beacon track line 22 and the target track line 24 are then calculated by the differential tracking line circuit 58. The output from the differential tracking line circuit 58 is delivered to the zero offset computation circuit 60, the output of which is delivered to the guidance control circuit 64 through the gate positioner circuit 62. The gate positioner circuit 62 then adjusts the encoded beam 16 by delivering control signals to the zoom lens 28 as well as to the temporal modulator circuit 66 which controls the projector 26.

It should be understood that the present invention was described in connection with one specific embodiment. By using the feedback according to the present invention, the instantaneous missile position may be determined with reference to the target position and the zero code region of the beam. The invention can be used when the position of the target is tracked by the operator, or when the target is tracked automatically. Other modifications will become apparent to one skilled in the art upon a study of the specification, drawings and the following claims.

What is claimed is:

1. A guidance apparatus for guiding a missile along a flight path to a target by a beam comprising:
   - means for projecting said beam, said flight path of said missile being determined by the orientation of said beam;
   - means for generating a signal when said missile is in a predetermined spatial relationship with respect to said beam; and
   - means for adjusting the orientation of said beam in response to said signal.

2. The apparatus of claim 1, wherein said beam has a zero code crossing, said means for adjusting the orientation of said beam being operable to adjust the position of said zero code crossing.

3. The apparatus of claim 2, wherein said means for generating a signal comprises:
   - a detector located on said missile operable to receive said beam and generate an output signal when said detector enters the zero code crossing of said beam;
   - a beacon located on said missile; and
   - a shutter responsive to said detector output signal and operable to effect selective display of said beacon.

4. The apparatus of claim 3, wherein said means for generating a signal further comprises a temporal demodulator circuit operable to close said shutter when said detector is outside of said predetermined spatial relationship with respect to said beam.

5. The apparatus of claim 4, wherein said means for projecting said beam comprises a laser and a spatial encoder circuit operable to generate a spatially encoded beam.

6. The apparatus of claim 1, wherein said means for adjusting the orientation of said beam comprises: (a) a beacon gate for tracking the position of said missile, (b) a target gate for tracking the location of said target, and (c) a differential tracking line circuit electrically communicating with said target gate and beacon gate, said differential tracking line circuit operable to determine the relative position of said target with respect to said missile.

7. The apparatus of claim 6, wherein said means for adjusting the orientation of said beam further comprises a zero offset computation circuit electrically communicating with said differential tracking line circuit and a gate positioner circuit, said gate positioner circuit determining corrections required to said center of said beam, and means for adjusting the beam in response to said required corrections.

8. A guidance apparatus for guiding a missile to a target by a spatially encoded beam comprising:

projection means for projecting said spatially encoded beam;

means for receiving said spatially encoded beam disposed on said missile;

means for producing a beacon signal when said missile is within a predetermined spatial relationship with respect to said spatially encoded beam;

means for determining the position of said missile relative to said target; and means for generating a control signal determined by said relative position, said control signal operable to cause said projection means to adjust the orientation of said beam.

9. The apparatus of claim 8, wherein said means for producing a beacon signal comprises a beacon and a shutter, said shutter operable to selectively display said beacon when said missile is in said predetermined spatial relationship with respect to said spatially encoded beam.

10. The apparatus of claim 9, wherein said means for producing a beacon signal further comprises a shutter control circuit operable to control said shutter.

11. The apparatus of claim 10, wherein said means for producing said beacon signal further comprises a temporal demodulator circuit electrically communicating with said means for receiving said spatially encoded beam, said temporal demodulator circuit operable to close said shutter when said missile is outside of said predetermined spatial relationship with respect to said spatially encoded beam.

12. The apparatus of claim 11, wherein said means for producing a beacon signal further comprises a zero crossing detector circuit operable to open said shutter when said missile is within said predetermined spatial relationship with respect to said beam.

13. The apparatus of claim 12, wherein said means for determining includes a thermal nightsight operable to receive thermal emissions from said target and said missile.

14. The apparatus of claim 13, wherein said means for determining comprises a target gate circuit operable to track the position of said target and a beacon gate operable to track the position of said missile.

15. The apparatus of claim 14, wherein said means for determining comprises a differential tracking line circuit operable to receive the output from said beacon gate and said target gate, said differential tracking line circuit operable to determine the relative position of said target with respect to said missile.

16. The apparatus of claim 15, wherein said means for determining further comprises a zero offset compensation circuit electrically communicating with said differential tracking line circuit.

17. A method for guiding a missile along a flight path to a target comprising the steps of:

projecting a spatially encoded beam from a projector in the direction of said target, said flight path of said missile being determined by the orientation of said spatially encoded beam;

receiving said spatially encoded beam by said missile;

generating a beacon signal when said missile is within a predetermined spatial relationship with respect to said spatially encoded beam;

receiving said beacon signal to allow the position of said missile with respect to said target to be determined; and adjusting the orientation of said spatially encoded beam in response to the position of said missile with respect to said target.

* * * * *